US008766152B1

(12) United States Patent
Flowers et al.

(10) Patent No.: US 8,766,152 B1
(45) Date of Patent: Jul. 1, 2014

(54) LASER GUIDED MUNITION IMPACT OFFSET

(75) Inventors: Edward Max Flowers, Grand Prairie, TX (US); Chad Nathan Chegwidden, Arlington, TX (US); Christopher L. Gould, Keller, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 722 days.

(21) Appl. No.: 12/836,697

(22) Filed: Jul. 15, 2010

Related U.S. Application Data

(60) Provisional application No. 61/226,574, filed on Jul. 17, 2009.

(51) Int. Cl.

| | |
|---|---|
| ***F41G 7/22*** | (2006.01) |
| ***F42B 15/01*** | (2006.01) |
| *F41G 7/00* | (2006.01) |
| *F42B 15/00* | (2006.01) |

(52) U.S. Cl.
USPC ..... 244/3.16; 244/3.1; 244/3.15; 244/3.21; 244/3.24; 250/336.1; 250/338.1; 250/353

(58) Field of Classification Search
USPC ..... 244/3.1–3.3; 89/1.11; 250/336.1, 338.1, 250/353, 200, 550, 493.1–504 H, 492.1; 359/1, 3; 356/3, 4.01, 5.01–5.15
See application file for complete search history.

(56) References Cited

U.S. PATENT DOCUMENTS 3,844,506 A * 10/1974 Stavis et al. ..... 244/3.15
4,165,464 A * 8/1979 Ikeda et al. ..... 250/550
4,179,088 A * 12/1979 French ..... 244/3.19
4,235,504 A * 11/1980 Ikeda et al. ..... 359/3
4,259,009 A * 3/1981 Jernigan ..... 244/3.16
6,903,343 B2 * 6/2005 Amon et al. ..... 250/353
7,219,853 B2 * 5/2007 Williams ..... 244/3.14
7,964,831 B2 * 6/2011 Hurty ..... 244/3.11

* cited by examiner

*Primary Examiner* — Bernarr Gregory
(74) *Attorney, Agent, or Firm* — Withrow & Terranova, PLLC

(57) ABSTRACT

The present invention includes, in various aspects and embodiments, a method and apparatus for guiding a laser guided munition to an offset aim point relative to the laser spot. In one aspect, the laser guided munition comprises a propelled explosive ordnance; an optical sensor; means for indicating an offset from a laser designation; and a flight control system. The flight control system is responsive to an output from the optical sensor to: home on the laser designation during the descent of an arcing trajectory for the propelled explosive ordnance; determine that the propelled explosive ordnance traversed a predetermined point in the descending trajectory; and upon traversing the predetermined point, guide the propelled explosive ordnance to the position defined by the offset indicator. In a second aspect, the laser guided munition is deployed as part of a system that also includes a laser designator. The laser designator includes: a laser capable of generating a laser signal; a lens though which a generated laser signal is transmitted; and a diffraction grating capable of diffracting the transmitted laser signal into a laser designation and an optical marker separated from the laser designation. In a third aspect, the invention includes a method for guiding a laser guided munition. The method, comprises: homing on a laser designation during the descent of an arcing trajectory for the laser guided munition; traversing a predetermined point in the descending trajectory; and upon traversing the predetermined point, guiding the laser guided munition to a position offset from the laser designation.

31 Claims, 3 Drawing Sheets

LASER GUIDED MUNITION IMPACT OFFSET

CROSS-REFERENCE TO RELATED APPLICATIONS

The priority of U.S. Provisional Application 61/226,574, entitled "Laser Guided Munition Impact Offset", filed Jun. 17, 2009, in the name of the inventors E. Max Flowers, et al. and commonly assigned herewith is hereby claimed under 35 U.S.C. §119(e). That application is also hereby expressly incorporate by reference in full and for all purposes as if set forth verbatim herein.

STATEMENT REGARDING FEDERALLY SPONSORED RESEARCH OR DEVELOPMENT

Not applicable.

BACKGROUND OF THE INVENTION

1. Field of the Invention

The present invention pertains to a technique for offsetting the impact of a laser guided weapon.

2. Description of the Related Art

This section of this document introduces various aspects of the art that may be related to various aspects of the present invention described and/or claimed below. It provides background information to facilitate a better understanding of the various aspects of the present invention. As the section's title implies, this is a discussion of "related" art. That such art is related in no way implies that it is also "prior" art. The related art may or may not be prior art. The discussion in this section of this document is to be read in this light, and not as admissions of prior art.

Laser guided munitions are used in a variety of roles on the battlefield, from small missiles, mortars, and artillery through large bombs. Laser guided munitions can be employed by a single soldier, dropped or launched from rotary and fixed wing aircraft, or launched by a crew from an artillery piece or missile launcher, either on land or seaborne. The laser spot that designates the desired impact point can either be generated by a designator carried and employed by a soldier, or be mounted on a fixed or rotary wing aircraft (or some other vehicular platform), for example. The laser guided munition can either be locked on to the laser designated aim point, or be delivered into a handover basket after launch via inertial or other measurements, and then lock on to the laser designated aim point for terminal guidance.

Laser guided munitions are very effective and accurate at engaging designated targets, both fixed and moving, when favorable atmospheric conditions prevail. However, laser guided munitions are only effective at engaging targets that are within the line of sight from the laser designator.

Consider a situation in which a gunman is hiding behind a stone or mud brick wall at a distance of several hundred meters and a soldier wishes to engage the threat he poses. In this situation, the solder is to engage the threat directly using organic weapons (weapons that are directly assigned to your unit). However all of the soldier's weapons systems rely on a clear line of sight to the target for successful engagement. Due to the close proximity of the soldier to the threat, a GPS guided air strike, projectile, or missile poses an unacceptably high risk to the soldier himself. The soldier is forced to maneuver within the battlespace to gain a clear line of engagement to the target, which will likely expose him to hostile attack as well.

The present invention is directed to resolving, or at least reducing, one or all of the problems mentioned above.

SUMMARY OF THE INVENTION

The present invention includes, in various aspects and embodiments, a technique for offsetting the impact of a laser guided munition from the laser designated spot.

In one aspect, the invention includes a method for offsetting the impact of a laser guided munition, comprising: homing on a laser designation during the descent of an arcing trajectory for the small arms explosive ordnance; traversing a predetermined point in the descending trajectory; and upon traversing the predetermined point, guiding the small arms explosive ordnance to a position offset from the laser designation.

In a second aspect, the invention includes a laser guided munition, comprising: a propelled explosive ordnance; an optical sensor; means for indicating an offset from a laser designation; and a flight control system. The flight control system is responsive to an output from the optical sensor to: home on the laser designation during the descent of an arcing trajectory for the propelled explosive ordnance; determine that the propelled explosive ordnance traversed a predetermined point in the descending trajectory; and upon traversing the predetermined point, guide the propelled explosive ordnance to the position defined by the offset indicator.

In a third aspect, the invention includes a laser designator, comprising: a laser capable of generating a laser signal; and a diffraction grating capable of diffracting the transmitted laser signal into a laser designation and an optical marker separated from the laser designation.

A weapon system, comprising: a laser designator and a laser guided munition. The laser designator includes: a laser capable of generating a laser signal; a lens though which a generated laser signal is transmitted; and a diffraction grating capable of diffracting the transmitted laser signal into a laser designation and an optical marker separated from the laser designation. The laser guided munition includes a propelled explosive ordnance; an optical sensor; means for indicating an offset from a laser designation; and a flight control system. The flight control system is responsive to an output from the optical sensor to: home on the laser designation during the descent of an arcing trajectory for the propelled explosive ordnance; determine that the propelled explosive ordnance traversed a predetermined point in the descending trajectory; and upon traversing the predetermined point, guide the propelled explosive ordnance to the position defined by the offset indicator.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

One or more specific embodiments of the present invention will be described below. The present invention is not limited to the embodiments and illustrations contained herein, but include modified forms of those embodiments including portions of the embodiments and combinations of elements of different embodiments as come within the scope of the appended claims. In the development of any such actual implementation, as in any engineering or design project, numerous implementation-specific decisions must be made to achieve the developers' specific goals, such as compliance with system-related and business related constraints, which may vary from one implementation to another. Moreover, such a development effort might be complex and time consuming, but would nevertheless be a routine undertaking of design, fabrication, and manufacture for those of ordinary skill having the benefit of this disclosure.

The term "laser guided munition" as used herein includes any munition that relies on the use of a laser to designate a desired impact point, where the laser is provided by some means not embodied within the munition itself. Current examples include artillery, missiles, mortars, and bombs. Existing kinds of munitions not typically laser guided can be modified to implement the present invention. For example, a grenade design can be modified to implement the present invention.

Figure 1:
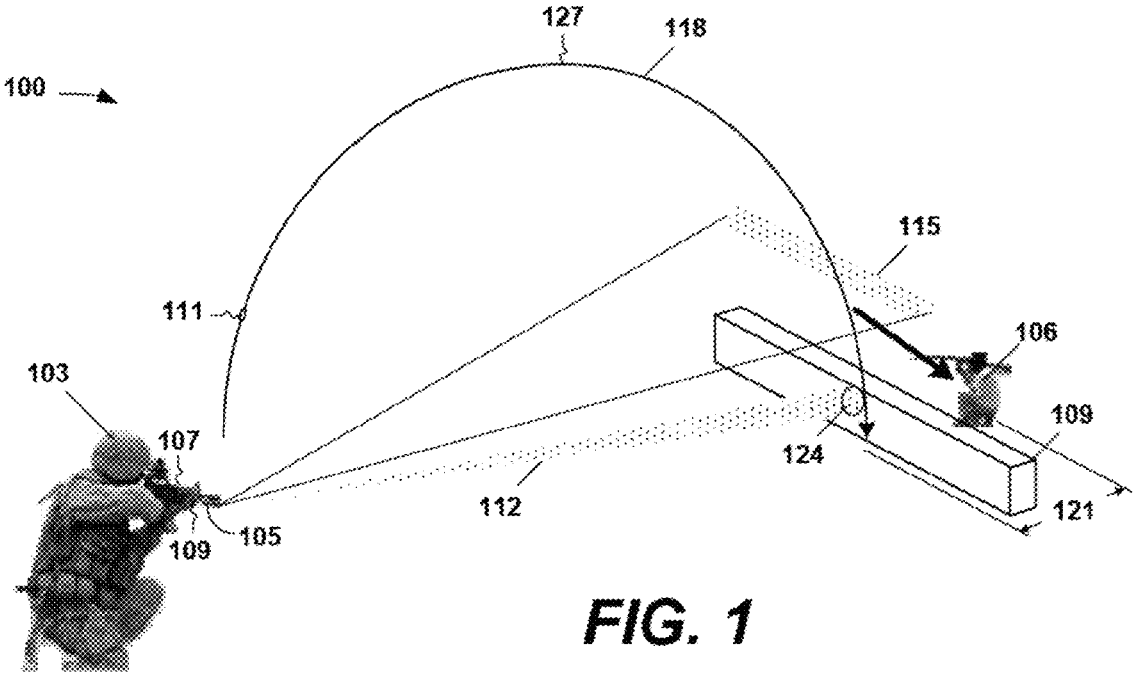
FIG. 1 depicts a scenario in which one particular embodiment of the present invention is deployed.

FIG. 1 illustrates a scenario 100 in which one particular embodiment of the present invention is deployed. The infantryman 103 seeks to eliminate the threat posed by the gunman 106 concealed behind the stone wall 109. In the illustrated embodiment, the infantryman 103 and the gunman 106 are separated by a distance between 300 m and 1200 m. Note that not all embodiments of the invention are limited to such ranges.

Although not shown, the gunman 106 is positioned such that the use of fire support from large, sophisticated weapons systems, such as missiles launched from airplanes or helicopters, is undesirable for fear of creating collateral damage. Similarly, powerful weapons system with complex fire control systems, such as those mounted on a main battle tank, are unavailable. The soldier 103 therefore is limited, in the scenario 100, to the small arms with which he has deployed. Again, this is a feature of the illustrated embodiment and is not necessary to the practice of the invention.

The infantryman 103 is armed with a rifle 107 equipped with a grenade launcher 109. The rifle 107 is also equipped with a laser designator 105. The laser designator 105 is co-boresighted with the site for the rifle 107. That is, when the infantryman 103 aims the rifle 107, he is also aiming the laser designator 105. The laser designator 105 of this particular embodiment generates a laser signal (not shown) in the near infrared region ("NIR") of the electromagnetic spectrum for example at 850 nm that is expanded enough to be eyesafe. Power (not shown) for the laser designator 105 may be a battery supply that is a part of and dedicated to the laser designator 105 or may be supplied from battery power such as that already carried into combat by many infantrymen.

Figure 2:
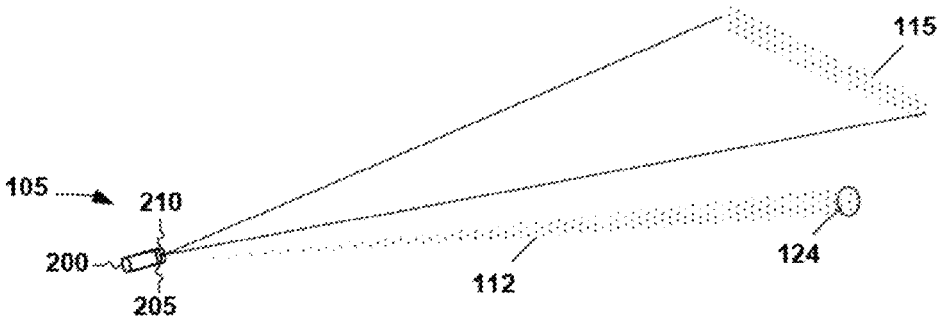
FIG. 2 conceptually illustrates the operation of the diffraction grating of the laser designator first shown in FIG. 1.

The laser designator 105, as shown in FIG. 2, includes a laser 200, a collimating lens 205, and a diffraction grating 210. The laser 200 generates a NIR laser signal (not shown) at, in this embodiment, 850 nm. The lens 205 collimates the signals and, if it is not eye safe as generated, then expands the laser signal so that it is eye-safe. The diffraction grating 210 splits the single laser signal to create the laser designation 112 and an optical marker 115. The laser designation 112 will comprise, in this particular embodiment, 80% of the laser energy in the original signal. The optical marker 115 will comprise the other 20%. Note that these proportions may vary in alternative embodiments.

Thus, in one aspect, the invention includes a laser designator comprising a laser, a lens and a diffraction grating. The laser is capable of generating a laser signal, and a diffraction grating capable of diffracting the transmitted laser signal into a laser designation and an optical marker separated from the laser designation. The laser designator will furthermore generally include a lens that will collimate the laser light. Also, unless the laser generates an eyesafe signal, the laser designator will use this same lens to expand the laser beam making it eyesafe.

Figure 3:
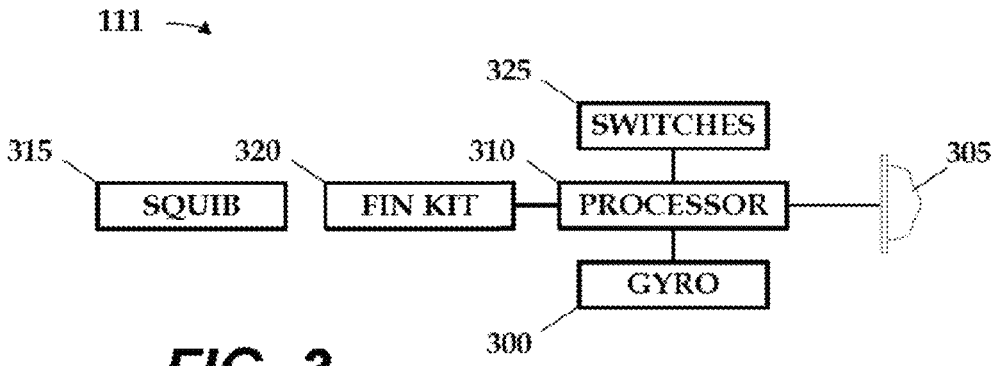
FIG. 3 is a conceptual block diagram of the munition first shown in FIG. 1.

Returning to FIG. 1, the grenade launcher 109 is designed to launch a grenade 111. The grenade 111 is conventional grenade modified as described herein. In the illustrated embodiment, the grenade is a 40 mm grenade, but the caliber is not material to the practice of the invention. A conventional grenade is modified to include, as shown in FIG. 3, a three-axis rate gyroscope 300, a sensor 305, a processor 310, a small rocket squib 315 and a simple fin kit 320. The conventional grenade is also modified to include means 325 for the user to select an offset from a laser designation. The selection means may be, for example, a dial or a series of switches, as are well known in the art, depending on the implementation.

As will be discussed in more detail below, the sensor 305 includes, in this particular embodiment, a charge-coupled device ("CCD") Silicon-based array, a plastic window, and a coated narrow band filter to match the laser designator wavelength. The CCD array may be, for example, one like those used in cell phone cameras. The plastic window may be a molded plastic lens. The processor 310 may be a simple processor (e.g., an appropriately programmed field programmable gate array ("FPGA")), a small rocket squib and a simple fin kit. The narrow band filter could be applied to the back of the window (or, lens), the front of the CCD imager or be a separate element between the two.

Thus, in a second aspect, the invention includes a laser guided munition, comprising: an explosive ordnance; an optical sensor; means for indicating an offset from a laser designation. The flight control system—centered on, for example, the processor mentioned above—to control the flight of the laser guided munition is described further below.

And, in a third aspect, then invention includes both the laser designator and the laser guided munition as a system.

Again returning to FIG. 1, the infantryman 103 sets the offset 121 on the grenade 111 by using the offset setting means 325—e.g., by setting a simple set of switches. The infantryman 103 fires the grenade 111 at a steep angle toward the target (e.g., the gunman 106) on the arcing trajectory 118. The infantryman 103 then points his rifle scope, or other sighting mechanism, with the side mounted laser designator 105 at the offset aim point, or laser designation 124. He activates the laser designator 105 and waits.

The grenade 111, once launched, fires the rocket squib 315 to increase its altitude. Spin may be induced with the launch or with the fins (not shown) of the fin kit 320 and the fins maintain this roll. In the illustrated embodiment, the three-axis gyroscope 300 tells the grenade 111 whether it has experienced a steep launch or a shallow launch. As the grenade 111 pitches over at the peak 127 of its trajectory 118, the processor 310 activates the sensor 305 looking for laser energy. When it sees the laser spot 124, the flight control system (i.e., the processor 310 and fin kit 320) uses the sensor 305 to guide toward that spot 124. When the sensor 305 detects laser energy in the bar, or optical marker, 115 over the spot 124 from the laser designator 105, it uses the inertial information from the trajectory to estimate how far from the shooter it has flown. The inertial information is provided by the gyroscope 300.

Figure 4A:
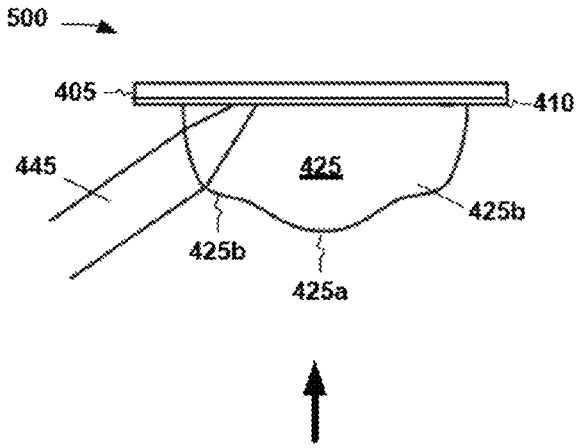
FIG. 4A-FIG. 4C depict a cylindrical torroidal lens that focuses the laser light from the optical marker in FIG. 1 onto the CCD array of the sensor.
Figure 4B:
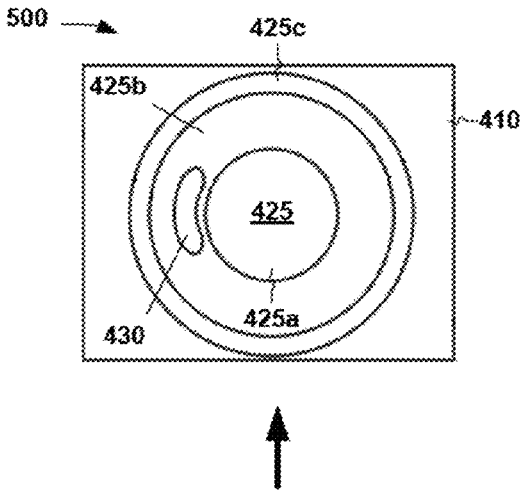
Figure 4C:
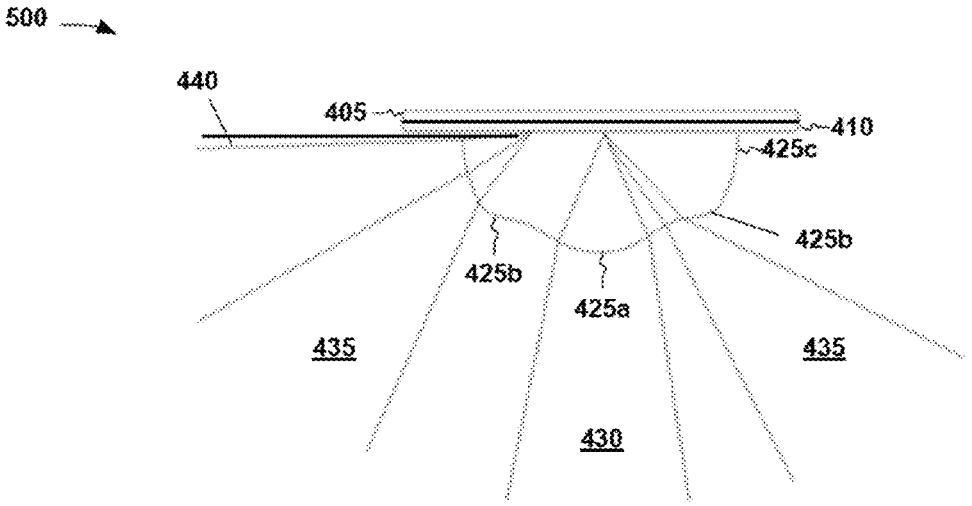

The processor 310 also uses the energy of the optical marker 115 to determine the direction from the infantryman 103. This is done by using a cylindrical torroidal lens 425 that focuses the laser light from the optical marker 115 onto the CCD array 405, both of which are shown in FIG. 4A-FIG. 4C and discussed further below. This semi-radial imaged light will tell the grenade 111 the direction to the designator 105. The grenade 111, through its flight control system, then applies the dialed in offset to alter its flight away from the shooter to the estimated offset 121 and detonates upon impact.

FIG. 4A-FIG. 4C illustrate a sensor 305 that can be used to implement many of the functionalities discussed above that occur off board the munition. FIG. 4A is a plan, side view from the direction indicated by the arrow in FIG. 4B. FIG. 4B is a plan bird's eye view from the direction indicated by the arrow in FIG. 4A.

The sensor 305 includes a CCD array 405 and a cylindrical toroidal lens 425. One of the CCD array 405 and the lens 425 has deposited upon it a narrow band filter coating 410. The coating 410 is shown layered on the CCD array 405, but not the lens 425 for the sake of clarity and so as not to obscure the present invention.

The lens 425 in this particular embodiment is actually a composite of three lenses 425*a*-425*c*. Referring now to FIG. 4B-FIG. 4C collectively, a center lens 425*a* sees laser light 430 from the designated laser spot 124, shown in FIG. 1. A middle lens 425*b* sees laser light 435 from the laser spot 124 at an off angle allowing the munition to close toward the designated laser spot 124. An edge lens 425*c* sees laser light 440 across a wide angle from the side illuminator. As is shown in FIG. 4A, laser light 445 from the optical marker 115, in FIG. 1, is also received via the middle lens 425*b*.

Figure 5:
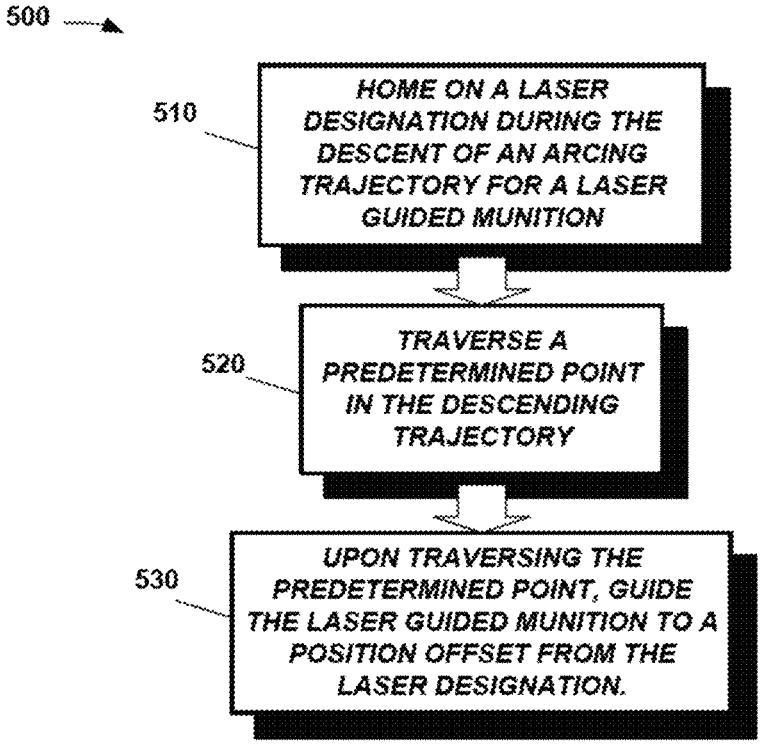
FIG. 5 illustrates a method for guiding a notional laser guided munition in accordance with one aspect of the present invention.

Thus, in another aspect, the invention includes a method for guiding a laser guided munition. The method 500, illustrated in FIG. 5, comprises: homing (at 510) on a laser designation during the descent of an arcing trajectory for a laser guided munition; traversing (at 520) a predetermined point in the descending trajectory; and, upon traversing the predetermined point, guiding (at 530) the laser guided munition to a position offset from the laser designation.

The phrase "capable of" as used herein is a recognition of the fact that some functions described for the various parts of the disclosed apparatus are performed only when the apparatus is powered and/or in operation. Those in the art having the benefit of this disclosure will appreciate that the embodiments illustrated herein include a number of electronic or electro-mechanical parts that, to operate, require electrical power. Even when provided with power, some functions described herein only occur when in operation. Thus, at times, some embodiments of the apparatus of the invention are "capable of" performing the recited functions even when they are not actually performing them—i.e., when there is no power or when they are powered but not in operation.

The following documents are hereby incorporated by reference as if set forth verbatim herein for all purposes as modified by the teaching herein:

U.S. application Ser. No. 11/733,917, entitled "Imaging Semi-Active LADAR System", filed Apr. 11, 2007, now U.S. Pat. No. 8,049,869, in the name of the inventors E. Max Flowers, et al., and commonly assigned herewith, for its teachings regarding homing ordnance on a laser designation by centering the return in on a CCD detector array; and U.S. Provisional Application 61/226,574, entitled "Laser Guided Munition Impact Offset", filed Jun. 17, 2009, in the name of the inventors E. Max Flowers, et al. and commonly assigned herewith for all purposes.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for offsetting an impact of a laser guided munition, comprising:

homing on a laser designation during a descent of an arcing trajectory for a small arms explosive ordnance, including:

detecting a return of the laser designation; and guiding the laser guided munition to center the laser designation return on a detector;

traversing a predetermined point in the descent of the arcing trajectory; and upon traversing the predetermined point, guiding the small arms explosive ordnance to a position offset from the laser designation.

2. The method of claim 1, wherein traversing the predetermined point includes:

sensing ambient optical energy;

detecting a marker of optical energy; and determining that the detected marker represents the predetermined point.

3. The method of claim 1, further comprising programming the position offset from the laser designation into the laser guided munition.

4. The method of claim 1, further comprising sensing the descent of the arcing trajectory.

5. The method of claim 4, wherein sensing the descent includes sensing an orientation of the small arms explosive ordnance relative to gravity.

6. The method of claim 1, further comprising laser designating a spot from which the position offset from the laser designation is measured.

7. The method of claim 6, wherein laser designating the spot includes generating an optical marker.

8. The method of claim 1, further comprising generating an optical marker.

9. The method of claim 1, further comprising:

detecting a passage of the small arms explosive ordnance through an optical marker;

determining the azimuth of the optical marker relative to the small arms explosive ordnance; and combining the optical marker azimuth with offset inputs to provide an offset aimpoint relative to the laser designation.

10. A laser guided munition, comprising:

a propelled explosive ordnance;

an optical sensor;

means for indicating an offset from a laser designation; and a flight control system responsive to an output from the optical sensor to:

home on the laser designation during a descent of an arcing trajectory for the propelled explosive ordnance;

determine that the propelled explosive ordnance traversed a predetermined point in the descent of the arcing trajectory; and upon traversing the predetermined point, guide the propelled explosive ordnance to a position defined by the offset indicator.

11. The laser guided munition of claim 10, wherein the propelled explosive ordnance comprises:

an explosive body;

means for propelling the explosive body; and a plurality of control surfaces for controlling flight of the explosive body.

12. The laser guided munition of claim 11, wherein the explosive body is a grenade or a mortar.

13. The laser guided munition of claim 11, wherein the means for propelling the explosive body comprises a rocket squib.

14. The laser guided munition of claim 11, wherein the control surfaces comprise a plurality of stabilizer fins.

15. The laser guided munition of claim 10, wherein the optical sensor is a charge-coupled device.

16. The laser guided munition of claim 10, wherein the means for indicating the offset from the laser designation comprises a plurality of switches.

17. The laser guided munition of claim 10, wherein the flight control system comprises a field programmable gate array.

18. The laser guided munition of claim 10, further comprising means for sensing an orientation of the laser guided munition relative to gravity.

19. The laser guided munition of claim 18, wherein the means for sensing the orientation comprises a three-axis gyroscope.

20. A laser designator, comprising:

a laser capable of transmitting a laser signal; and a diffraction grating capable of diffracting the transmitted laser signal to concurrently form a laser designation and an optical marker, the optical marker located at an altitude above an altitude of the laser designation.

21. The laser designator of claim 20, further comprising a lens through which the laser signal is transmitted and which protects the laser.

22. The laser designator of claim 20, further comprising means for expanding the laser signal.

23. The laser designator of claim 20, wherein the laser designation comprises a first laser beam configured to form a circular pattern, and the optical marker comprises a second laser beam configured to form a rectangular pattern.

24. The laser designator of claim 20, wherein the diffraction grating diffracts a majority of an energy of the laser signal to form the laser designation and diffracts a minority of the energy of the laser signal to form the optical marker.

25. The laser designator of claim 24, wherein the laser designation comprises eighty percent of the energy of the laser signal, and the optical marker comprises twenty percent of the energy of the laser signal.

26. A weapon system, comprising:

a laser designator, including:

a laser capable of generating a laser signal;

a lens through which the generated laser signal is transmitted;

a diffraction grating capable of diffracting the transmitted laser signal into a laser designation and an optical marker separated from the laser designation; and a laser guided munition, including:

a propelled explosive ordnance;

an optical sensor;

means for indicating an offset from the laser designation; and a flight control system responsive to an output from the optical sensor to:

home on the laser designation during a descent of an arcing trajectory for the propelled explosive ordnance;

determine that the propelled explosive ordnance traversed a predetermined point in the descent of the arcing trajectory; and upon traversing the predetermined point, guide the propelled explosive ordnance to a position defined by the offset indicator.

27. A method for offsetting an impact of a laser guided munition, comprising:

homing on a laser designation during a descent of an arcing trajectory for a small arms explosive ordnance;

traversing a predetermined point in the descent of the arcing trajectory, including:

sensing ambient optical energy;

detecting a marker of optical energy; and determining that the detected marker represents the predetermined point; and upon traversing the predetermined point, guiding the small arms explosive ordnance to a position offset from the laser designation.

28. A method for offsetting an impact of a laser guided munition, comprising:

sensing a descent of an arcing trajectory for a small arms explosive ordnance;

sensing an orientation of the small arms explosive ordnance relative to gravity;

homing on a laser designation during the descent of the arcing trajectory for the small arms explosive ordnance;

traversing a predetermined point in the descent of the arcing trajectory; and upon traversing the predetermined point, guiding the small arms explosive ordnance to a position offset from the laser designation.

29. A method for offsetting an impact of a laser guided munition, comprising:

laser designating a spot;

homing on a laser designation of the spot during a descent of an arcing trajectory for a small arms explosive ordnance;

traversing a predetermined point in the descent of the arcing trajectory; and upon traversing the predetermined point, guiding the small arms explosive ordnance to a position offset from the laser designation of the spot.

30. A method for offsetting an impact of a laser guided munition, comprising:

generating an optical marker;

homing on a laser designation during a descent of an arcing trajectory for a small arms explosive ordnance;

traversing a predetermined point in the descent of the arcing trajectory; and upon traversing the predetermined point, guiding the small arms explosive ordnance to a position offset from the laser designation.

31. A method for offsetting an impact of a laser guided munition, comprising:

homing on a laser spot during a descent of an arcing trajectory for a small arms explosive ordnance;

traversing a predetermined point in the descent of the arcing trajectory for the small arms explosive ordnance by detecting a passage of the small arms explosive ordnance through an optical marker;

determining an optical marker azimuth of the optical marker relative to the small arms explosive ordnance;

combining the optical marker azimuth with offset inputs to provide an offset aimpoint relative to the laser spot; and guiding the small arms explosive ordnance to the offset aimpoint.

* * * * *